US007243525B2

(12) United States Patent
Galluzo

(10) Patent No.: US 7,243,525 B2
(45) Date of Patent: Jul. 17, 2007

(54) MULTI-ANGLE HAND RIVET SQUEEZER

(76) Inventor: Charles Galluzo, 2002 Anaheim Ave., Costa Mesa, CA (US) 92627

( * ) Notice: Subject to any disclaimer, the term of this patent is extended or adjusted under 35 U.S.C. 154(b) by 192 days.

(21) Appl. No.: 11/074,235

(22) Filed: Feb. 15, 2005

(65) Prior Publication Data

US 2006/0179911 A1 Aug. 17, 2006

(51) Int. Cl.
*B21J 15/00* (2006.01)

(52) U.S. Cl. ..... 72/409.1; 72/409.01; 72/391.2; 29/243.53

(58) Field of Classification Search ..... 72/409.01, 72/409.1, 391.4, 391.8, 391.2; 29/243.519–243.529, 29/243.53, 243.54; 81/394, 427.5
See application file for complete search history.

(56) References Cited

U.S. PATENT DOCUMENTS

| | | | | | |
|---|---|---|---|---|---|
| 637,489 | A | | 11/1899 | Thompson | |
| 1,507,958 | A | * | 9/1924 | Thorvald et al. | 29/243.54 |
| 2,365,538 | A | * | 12/1944 | Fischer | 72/432 |
| 4,094,215 | A | | 6/1978 | Hudson | |
| 4,344,311 | A | * | 8/1982 | Inoue | 29/243.528 |
| 4,347,729 | A | | 9/1982 | Mitani | |
| 4,653,308 | A | | 3/1987 | Gregory | |
| 4,807,460 | A | * | 2/1989 | Tzong | 29/243.528 |
| 5,050,420 | A | * | 9/1991 | Liu | 72/391.4 |
| 5,361,474 | A | * | 11/1994 | Yang | 29/243.528 |
| 6,233,803 | B1 | | 5/2001 | Rose | |
| 6,421,900 | B1 | | 7/2002 | Hunt | |
| 6,588,246 | B2 | | 7/2003 | Ko | |
| 6,651,301 | B1 | * | 11/2003 | Liu | 29/243.521 |

* cited by examiner

*Primary Examiner*—Daniel C. Crane
(74) *Attorney, Agent, or Firm*—Robert J. Lauson; Lauson & Schewe LLP

(57) ABSTRACT

A hand rivet squeezer with adjustable handles includes a riveting head body, and C-shaped anvil yoke and stationary and lever swing-arm handles attached to the body. A mechanical linkage inside the body converts pivoting forces applied to the lever swing-arm into axial forces applied to a plunger pushing it from inside the body into the C-shaped yoke. The preferred mechanical linkage is a rack-and-pinion type design or alternatively a cam between the lever swing arm and the plunger. The handles are adjustable such that their angle relative the rivet head body can be varied depending on the access available around a solid rivet to be installed. The handles are engaged or locked to the body but may be unlocked or slidably disengaged and pivoted up to 90 degrees relative the body.

16 Claims, 5 Drawing Sheets

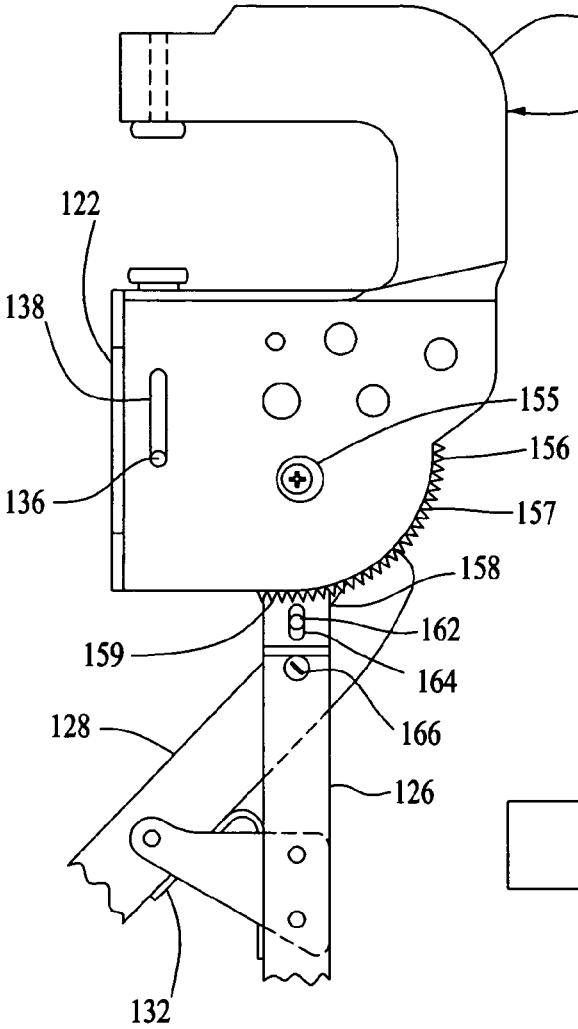
FIG. 8
FIG. 9
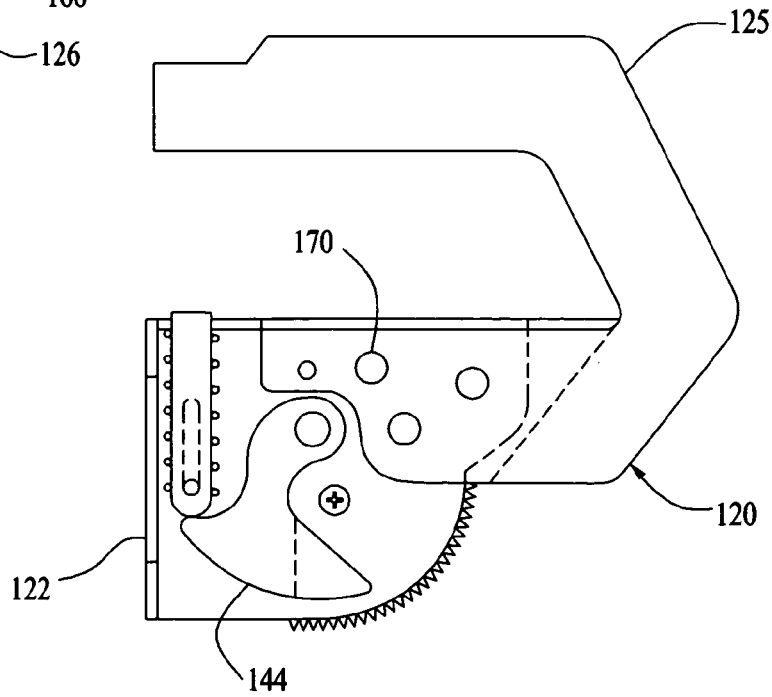

MULTI-ANGLE HAND RIVET SQUEEZER

CROSS-REFERENCE TO RELATED DOCUMENTS

This application is based in part on Disclosure Document No. 542041 filed Nov. 17, 2003.

BACKGROUND OF THE INVENTION

1. Field of the Invention

The present invention relates to generally to manual riveting tools, and more particularly to a rivet squeezer with a repositionable yoke for making access possible to otherwise inaccessible rivets.

2. Description of the Related Art

Rivets remain a popular fastening choice not only in aircraft assembly but also in other vehicles such as trucks, buses, boats and the like. Aircraft preventive maintenance, especially helicopters, is intensive in view of the high degree of reliability required and vibration loads typically present. Replacing rivets that are difficult to access in a completed helicopter assembly is a recurring challenge. Although blind rivets requiring access only on one side of the rivet for installation can sometimes be utilized in less-critical joints, solid rivets are preferred from both a cost and structural-integrity standpoint.

In aircraft maintenance solid rivets are most commonly installed by two mechanics, one using a rivet gun and the second a bucking bar on the opposite side of the rivet. Conventional rivet squeezers are used by a single mechanic to squeeze both sides and install a small number of solid rivets. Such tools generally have a pair of handles one stationary and the other operating as a lever arm engaging a mechanical linkage that moves a plunger up and down (approximately along the axis of the stationary handle) inside a C-shaped yoke portion of the tool. Still these tools are difficult to use if the access is such that upon attempting to position the riveting head and anvil yoke around a rivet other surrounding aircraft structure is in the way of the handles.

Accordingly, it is an object of the present invention to provide a hand tool for a single mechanic installing solid rivets in tight spaces where access is limited. It is a further object of the present invention to provide a rivet squeezer with a head and yoke portion that are adjustable relative the handles to make the most of whatever access is available. It is a still further object of the invention to provide a rivet squeezer with an effective mechanical linkage to convert the forces applied to the handles into the forces necessary to properly install the solid rivets, and to do so however the rivet squeezer is configured for access.

SUMMARY OF THE INVENTION

A rivet squeezer in accordance with the present invention includes a riveting head body, and C-shaped anvil yoke and stationary and lever swing-arm handles attached to the body. A mechanical linkage converts pivoting forces applied to the lever swing-arm into axial forces applied to a plunger pushing it from inside the body into the C-shaped yoke. The handles are adjustable such that their angle relative the rivet head body and yoke can be varied depending on the access available around a solid rivet to be installed. Preferably there is a leaf spring between the two, coupled together handles to keep them biased apart.

The preferred mechanical linkage is a rack-and-pinion type design having an engagement gear connected to the lever swing arm with teeth intermeshed in corresponding teeth in the plunger, and a second offset engagement gear may further be included. Alternatively, the linkage may include a cam pivotally connected to the body such that forces applied to the lever swing arm are again transferred into the plunger causing its axial movement.

Preferably the adjustable handles are connected to the body by an engagement pin that may be slidably disengaged to enable temporary separating of the gear teeth and pivoting of the handles to another position, and then the gear teeth pushed back to mesh with one another and the handles locked in place at the new orientation. Alternatively, the stationary handle may have a lock with a few serrations, and the body a number of corresponding serrations such that the stationary handle may be engaged and locked at a number of angles relative the body and yoke.

These and other advantages of the present invention will become apparent upon reading the following detailed description and upon reference to the accompanying drawings.

BRIEF DESCRIPTION OF THE SEVERAL VIEWS OF THE DRAWINGS

FIG. 8 is a rear elevation view of the alternate embodiment rivet head body showing the stationary handle lock;

FIG. 9 is a front elevation view of the rivet head of the alternate embodiment (with a portion of the housing removed for illustrative purposes and minus the handles) showing a "deep throat" anvil yoke.

Figure 1:
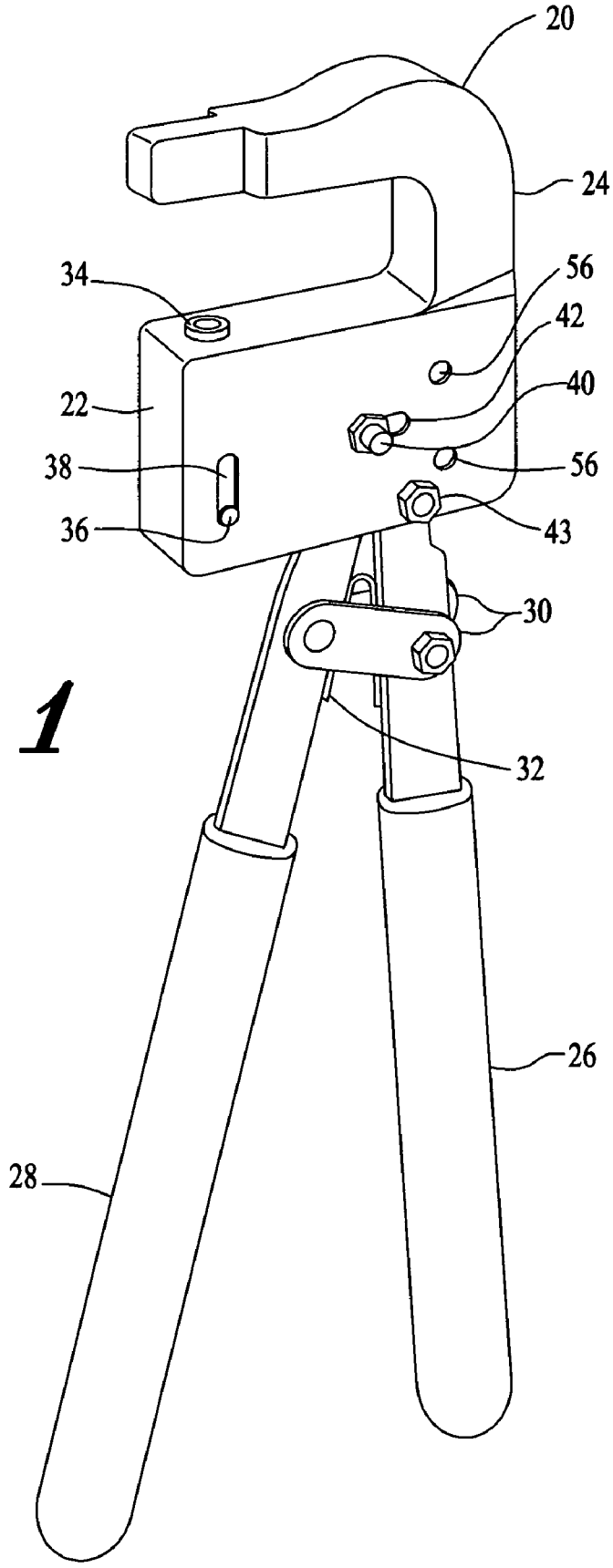
FIG. 1 is a front perspective view of the rivet squeezer of the preferred embodiment of the present invention.

LISTING OF REFERENCE NUMERALS hand rivet squeezer 20
riveting head body 22
C-shaped yoke 24
adjustable stationary handle 26
lever swing arm handle 28
handle hinges 30
handle leaf spring 32
plunger 34
plunger guide pin 36
guide pin slot 38 engagement gears pin 40
gears pin slot 42
engagement lock pin 43
rack-and-pinion mechanical linkage 44
first engagement gear 46
first set of corresponding teeth 48
second engagement gear 50
second set of set of corresponding teeth 52
engagement gear fasteners 55
engagement lock bores 56
engagement lock bore 58
plunger spring 60
hand rivet squeezer 120
riveting head body 122
C-shaped yoke 124
deep throat anvil yoke 125
adjustable stationary handle 126
lever swing arm handle 128
handle hinge 130
leaf spring 132
plunger 134
plunger guide pin 136
guide pin slot 138
cam pin 140
cam 144
handle pivot pin 155
curved surface 156
body serrations 157
handle lock 158
lock serrations 159
plunger spring 160
lock pin 162
lock slot 164
lock screw 166
rivet heads 168
yoke pins 170

DESCRIPTION OF THE PREFERRED EMBODIMENTS

Initially referring to FIG. 1, shown is a hand rivet squeezer 20 having a riveting head body 22, a C-shaped yoke 24, an adjustable stationary handle 26 and a lever swing arm handle 28. The handles 26, 28 are preferably connected by a pair of handle hinges 30 and there is preferably a leaf spring 32 between the handles 26, 28. A plunger 34 protrudes slightly outside the riveting head body 22 and it has a guide pin 36 housed in a slot 38. Additionally, there is an engagement gear pin 40 housed in a slot 42, and an engagement lock pin 43 in one of three engagement lock bores 56. Also note that the yoke 24 preferably tapers and is narrower in the region above the plunger 34.

Figure 2:
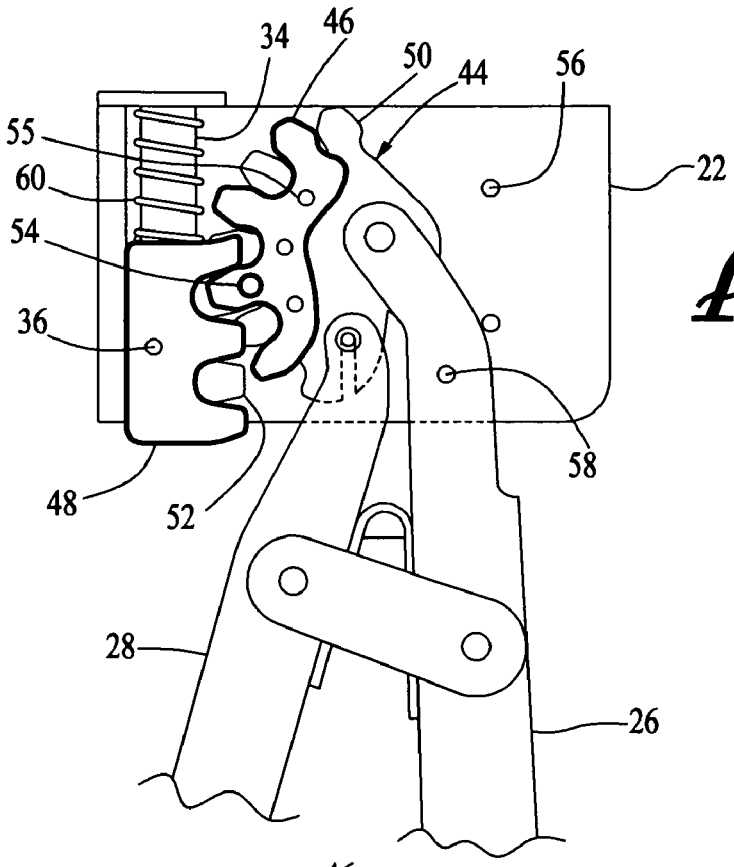
FIG. 2 is a front elevation view of the preferred embodiment rivet head body (with a portion of the housing and handles removed for illustrative purposes and minus the anvil yoke) showing a rack-and-pinion mechanical linkage in the standard zero degree, not actuated handle position, with portions of the linkage highlighted.
Figure 3:
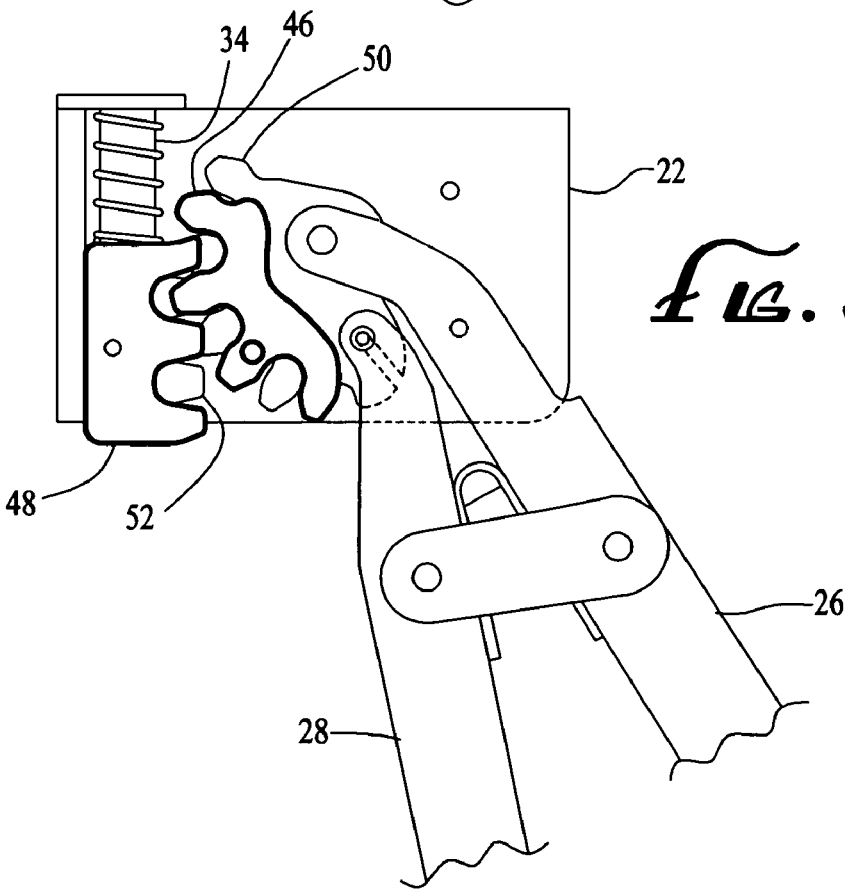
FIG. 3 is the front elevation view of FIG. 2 in the forty-five (45) degrees, not actuated handle position, with portions of the linkage highlighted.
Figure 4:
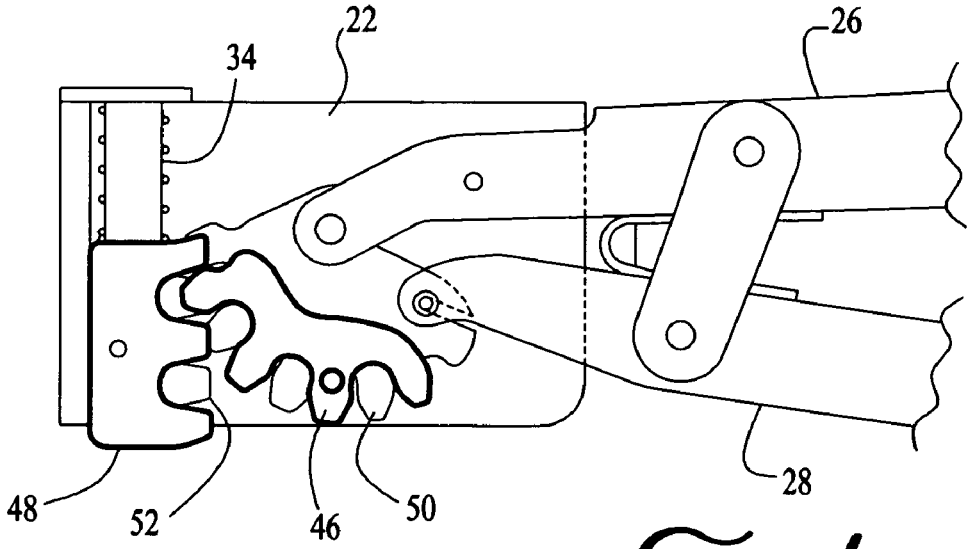
FIG. 4 is the front elevation view of FIG. 2 in the ninety (90) degrees, not actuated handle position, with portions of the linkage highlighted.

Now also referring to FIGS. 2-4, with a portion of the riveting head body 22 removed for purposes of illustration, the components inside may be discussed including a rack-and-pinion mechanical linkage 44 that connects the lever swing arm 28 to the plunger 34. The mechanical linkage 44 preferably includes a first engagement gear 46 and a first set of corresponding teeth 48 built into the lower portion of the plunger 34 (note that this near portion of the linkage 44 is highlighted in these figures to lend clarity to the illustrations). Additionally, there is an offset, second engagement gear 50 (fixedly attached to the first engagement gear 46 by a plurality of fasteners 55) and a second set of corresponding teeth 52 (also offset), attached to the plunger 34. Note the second engagement gear 50 is slotted where it is attached to the lever swing arm handle 28. Also note there are three (3) engagement lock bores 56 in the body 22 and a single corresponding engagement lock bore 58 in the stationary handle 26. Lastly, disposed about the plunger 34 there is a compression spring 60.

FIGS. 1, 2 shows the adjustable, stationary handle 26 engaged at the 0 degrees position such that it is approximately parallel to the axis of the plunger 34, i.e. the engagement lock pin. FIG. 3 shows the handles 26, 28 engaged at the 45 degrees position, while FIG. 4 shows the handles 26, 28 at the 90 degrees position. To switch between the various angled positions, the engagement lock pin 43 is removed and the engagement gear pin 40 is loosened such that it can slide aft in the riveting head body 22 thereby disengaging the first and second engagement gears 46, 50 from the corresponding sets of teeth 48, 54, and enabling pivoting of the handles 26, 28. Then upon the handles 26, 28 being in the desired position, 0, 45 or 90 degrees, the handles 26, 28 are slid forward relative the body 22 and the engagement lock pin 43 reinstalled into the engagement lock bores 56, 58.

The hand rivet squeezer 20 is used by placing the C-shaped yoke 24 around surfaces to be joined with a solid rivet (not shown), and aligning the plunger 34 with the rivet and pushing the handles 26, 28 together, causing axial movement of the plunger 24 towards the yoke 24 (to the actuated position (not shown)) thereby squeezing and installing the rivet. When the forces squeezing the handles 26, 28 together are released the handles 26, 28 spring back apart, causing the plunger 34 to retreat axially away from the yoke 24 and back inside the body 22.

Figure 5:
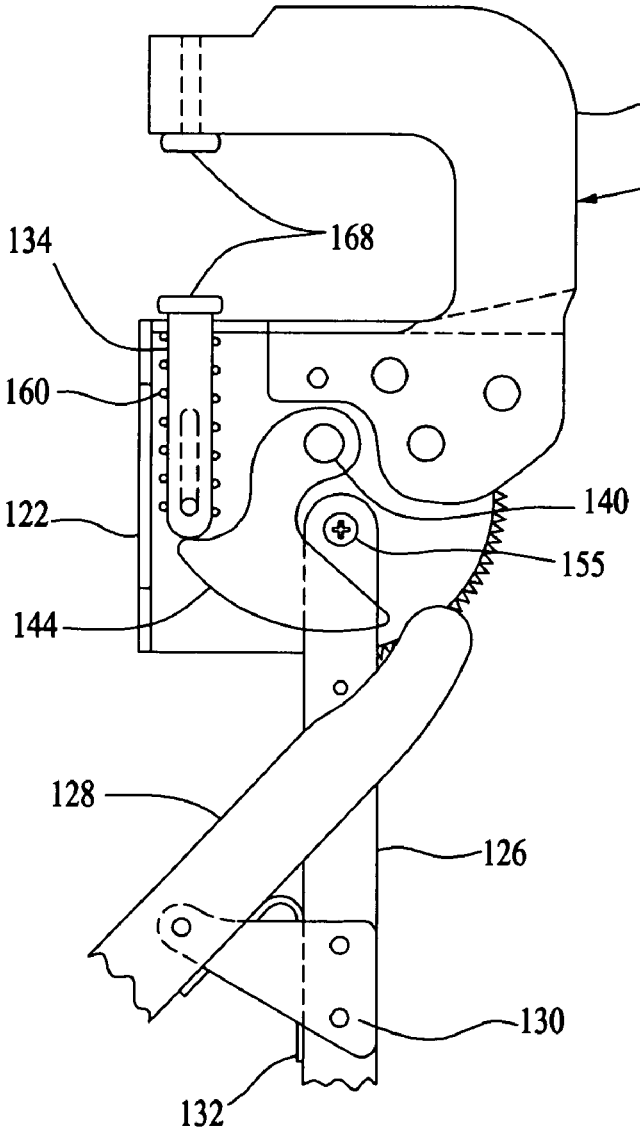
FIG. 5 is a front elevation view of an alternate embodiment rivet head body (with a portion of the housing removed for illustrative purposes) showing a cam mechanical linkage in the standard zero degree, not actuated handle position.
Figure 6:
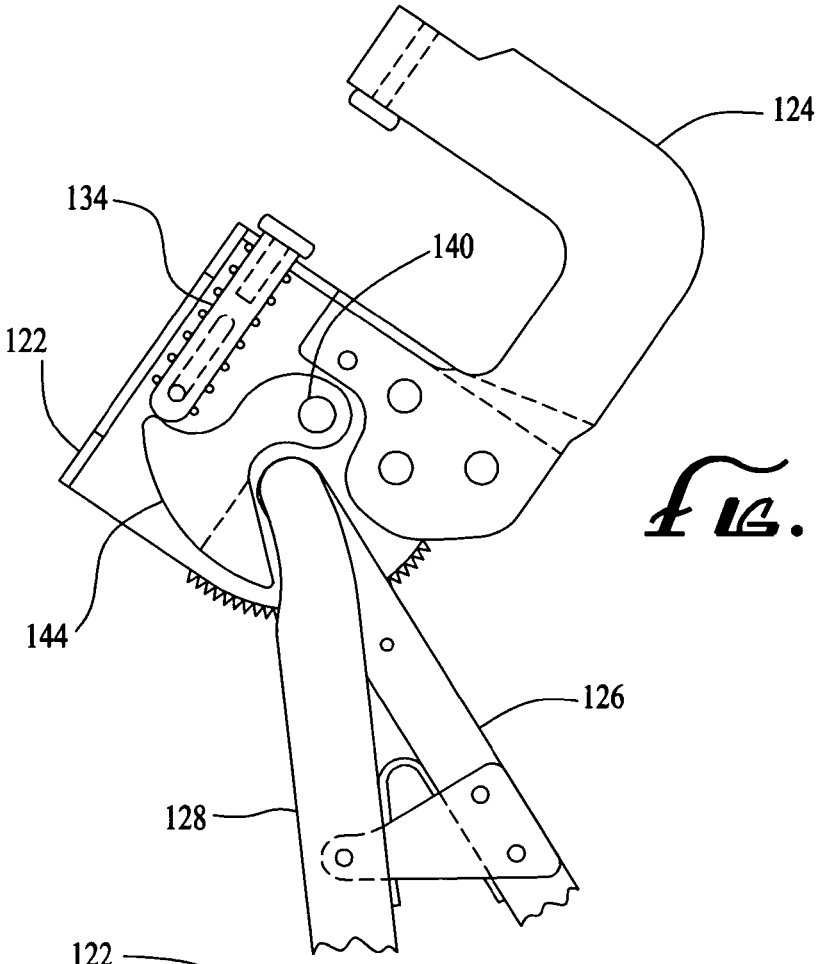
FIG. 6 is the front elevation of FIG. 5 in the forty-five (45) degrees, not actuated handle position.
Figure 7:
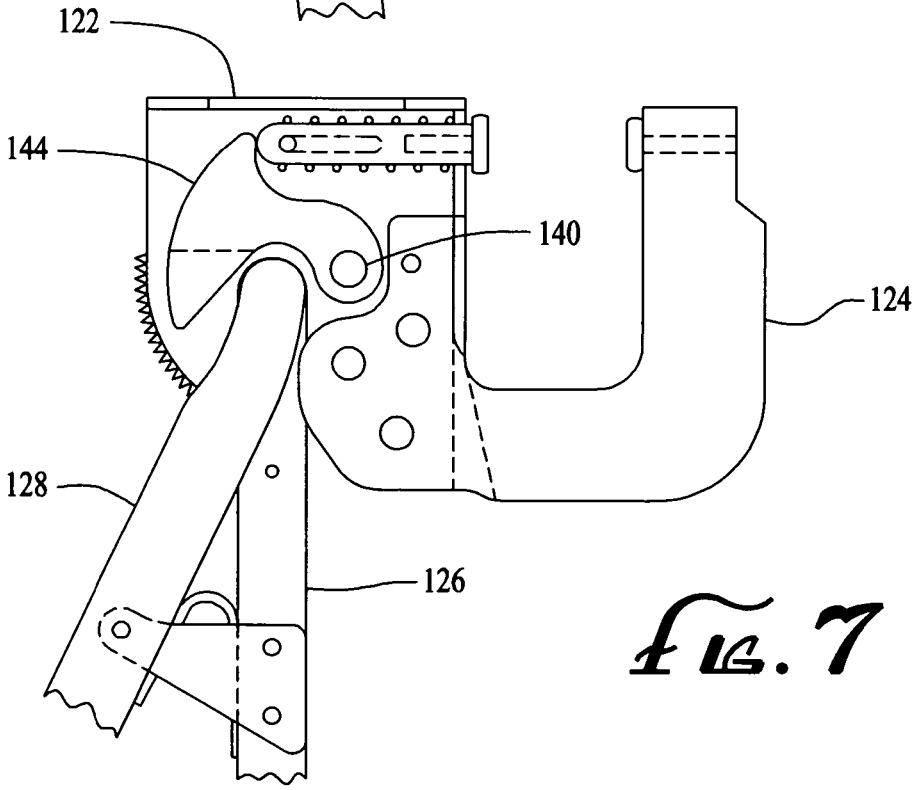
FIG. 7 is the front elevation of FIG. 5 in the ninety (90) degrees, not actuated handle position.

Next referring to FIGS. 5-7, shown is an alternate embodiment hand rivet squeezer 120 having a riveting head body 122, C-shaped yoke 124, adjustable stationary handle 126 and lever swing arm handle 128, and handle hinge 130 and leaf spring 132 there between, and a pair of rivet heads 168. Inside the body 122 is a plunger 134 and mechanical linkage including a cam 144, that pivots about a cam pin 140 and transfers the pivoting forces from the lever swing arm 128 into forces causing axial movement of the plunger 134 into the actuated position (not shown). This occurs whether the handles 126, 128 are in the 0 degrees (FIG. 5), 45 degrees (FIG. 6) or 90 degrees (FIG. 7) position or somewhere in between.

FIG. 8 shows the stationary handle 126 having a moveable lock 158 with a plurality of serrations 159, and the body 122 having a curved surface 156 with a multiplicity of corresponding serrations 157. The lock 158 has a pin 162 that rides in a slot 164 in the handle 126, and there is a screw 166 that holds the lock 158 in the locked position with the corresponding serrations 157, 159 engaged. Removal of the screw 166 allows downward movement of the lock 158 to disengage the corresponding serrations 157, 159, thereby unlocking the handle 126. When unlocked, the handle 126 is free to pivot about the handle pivot pin 155. Then once the desired angle of the handles 126, 128 relative the body 122 and yoke 124 is achieved, then the steps are reversed to lock the handles 126, 128 at the new position.

Finally, FIG. 9 shows the alternate embodiment 120 with a different anvil deep throat yoke 125, held on by three (3) fasteners 170.

The present invention has been described in connection with preferred and alternate embodiments, but it is understood that modifications will occur to those skilled in the appertaining arts that are within the spirit of the invention disclosed and within the scope of the claims.

What is claimed is:

1. A rivet squeezer comprising:

a riveting head body;

a C-shaped yoke connected to the body and extending away from the body forming an anvil;

a stationary handle releasably fixedly attached and pivotally attached to the body;

a lever swing arm handle pivotally attached to the body; and, a mechanical linkage connected from the lever swing arm handle to a plunger to convert pivoting forces applied to the lever swing arm handle into axial forces applied to the plunger tending to push the plunger outside the body towards the anvil; and the stationary handle upon being released from fixed attachment to the body being pivotable relative the body thereby adjusting the stationary handle angle relative the body.

2. The rivet squeezer of claim 1 wherein the mechanical linkage comprises:

a first engagement gear connected to the lever swing arm handle and having one or more teeth;

the plunger having one or more corresponding teeth and engaged with the first engagement gear.

3. The rivet squeezer of claim 2 wherein the mechanical linkage further comprises:

a second engagement gear connected to the lever swing arm handle and having one or more teeth;

the plunger having a second set of one or more corresponding teeth and engaged with the second engagement gear.

4. The rivet squeezer of claim 1 wherein the plunger is slidably connected to the riveting head body.

5. The rivet squeezer of claim 1 wherein the stationary handle is slidably connected to the body such that in releasing the stationary handle the engagement gear teeth and plunger teeth can be pulled apart and disengaged.

6. The rivet squeezer of claim 5 further comprising an engagement lock pin connected to the stationary handle and the body to prevent the stationary handle from sliding relative the body except when being adjusted.

7. The rivet squeezer of claim 6 wherein the body has a plurality of engagement lock bores sized to accept the engagement lock pin at selected positions of pivoting of the stationary handle.

8. The rivet squeezer of claim 1 wherein the handles are coupled together.

9. A rivet squeezer comprising:

a riveting head body;

an anvil extending away from the body;

a stationary handle releasably fixedly attached and pivotally attached to the body;

a lever swing arm handle pivotally attached to the body; and, a mechanical linkage connected to the lever swing arm handle to convert pivoting forces applied to the lever swing arm handle into axial forces applied to a plunger tending to push the plunger outside the body towards the anvil; and the stationary handle upon being released from fixed attachment to the body being pivotable relative the body thereby adjusting the stationary handle angle relative the body;

wherein the mechanical linkage comprises:

a first engagement gear connected to the lever swing arm handle and having one or more teeth;

the plunger having one or more corresponding teeth and engaged with the first engagement gear;

and wherein the engagement gears are fixedly connected together with the teeth offset from one another and the sets of teeth in the plunger are correspondingly offset.

10. A rivet squeezer comprising:

a riveting head body;

an anvil extending away from the body;

a stationary handle releasably fixedly attached and pivotally attached to the body;

a lever swing arm handle pivotally attached to the body; and, a mechanical linkage connected to the lever swing arm handle to convert pivoting forces applied to the lever swing arm handle into axial forces applied to a plunger tending to rush the plunger outside the body towards the anvil; and the stationary handle upon being released from fixed attachment to the body being pivotable relative the body thereby adjusting the stationary handle angle relative the body;

wherein the mechanical linkage comprises a cam pivotally connected to the body and configured such that forces applied to the lever swing arm handle are transferred to the plunger.

11. The rivet squeezer of claim 10 wherein the plunger is slidably connected to the riveting head body.

12. The rivet squeezer of claim 10 wherein:

the stationary handle has a moveable lock with one or more serrations; and the body has a multiplicity of corresponding serrations such that the stationary handle may be engaged and locked at a multiplicity of angles relative the body.

13. The rivet squeezer of claim 10 wherein the handles are coupled together.

14. The rivet squeezer of claim 10 further comprising a compressions spring between the plunger and the body to bias the plunger to the first position inside the body.

15. The rivet squeezer of claim 10 further comprising a leaf spring between the handles to bias the handles apart from one another.

16. The rivet squeezer of claim 10 wherein the anvil is removable and interchangeable with other anvils.

* * * * *